US012150518B2

(12) United States Patent
Reddy et al.

(10) Patent No.: US 12,150,518 B2
(45) Date of Patent: Nov. 26, 2024

(54) FOOTBED FOR FOOTWEAR

(71) Applicants: Prasad Reddy, Argyle, TX (US); Tuan Le, Portland, OR (US)

(72) Inventors: Prasad Reddy, Argyle, TX (US); Tuan Le, Portland, OR (US)

(73) Assignee: Twisted X, Inc., Decatur, TX (US)

( * ) Notice: Subject to any disclaimer, the term of this patent is extended or adjusted under 35 U.S.C. 154(b) by 118 days.

(21) Appl. No.: 17/672,859

(22) Filed: Feb. 16, 2022

(65) Prior Publication Data

US 2022/0167710 A1 Jun. 2, 2022

Related U.S. Application Data

(63) Continuation-in-part of application No. 16/407,972, filed on May 9, 2019, now Pat. No. 11,330,863.

(60) Provisional application No. 62/671,085, filed on May 14, 2018.

(51) Int. Cl.

| | |
|---|---|
| ***A43B 17/02*** | (2006.01) |
| ***A43B 13/18*** | (2006.01) |
| ***A43B 17/14*** | (2006.01) |

(52) U.S. Cl.

CPC ..... *A43B 17/02* (2013.01); *A43B 13/186* (2013.01); *A43B 13/188* (2013.01); *A43B 17/14* (2013.01)

(58) Field of Classification Search

CPC ..... A43B 17/02; A43B 17/04; A43B 13/186; A43B 13/188

See application file for complete search history.

(56) References Cited

U.S. PATENT DOCUMENTS

| | | | | |
|---|---|---|---|---|
| 4,658,515 A | | 4/1987 | Oatman | |
| 4,970,807 A | * | 11/1990 | Anderie | A43B 1/0072 36/35 R |
| 5,005,300 A | * | 4/1991 | Diaz | A43B 13/203 36/31 |
| 5,392,534 A | | 2/1995 | Grim | |
| 5,758,435 A | * | 6/1998 | Miyata | A43B 1/0009 36/25 R |

(Continued)

FOREIGN PATENT DOCUMENTS

| | | | |
|---|---|---|---|
| EP | 0383685 | | 4/1994 |
| KR | 20090019952 A | * | 2/2009 |

(Continued)

*Primary Examiner* — Ted Kavanaugh

(74) *Attorney, Agent, or Firm* — Brian K. Yost; Decker Jones, PC

(57) ABSTRACT

A footbed comprises a cushion comprising a heel portion, a forefoot portion, and a lower surface. The heel and forefoot portions each comprise resilient balls located in a resilient matrix material. The balls have a first hardness measure, and the matrix material has a second hardness measure that is different than the first hardness measure. The balls in the forefoot portion are of a first diameter and the balls in the heel portion are of a second diameter, the first diameter being smaller than the second diameter. The heel portion is separated from the forefoot portion by a midfoot portion. Each of the balls in the cushion may be interconnected with adjacent respective balls by spacing pins, the spacing pins creating gaps between adjacent respective balls, the matrix material being located in the gaps. The matrix material substantially surrounds each of the balls in the cushion.

15 Claims, 3 Drawing Sheets

(56) References Cited

U.S. PATENT DOCUMENTS

| | | | | |
|---|---|---|---|---|
| 6,061,928 | A * | 5/2000 | Nichols | A43B 13/181 36/28 |
| 8,347,526 | B2 | 1/2013 | Goldston et al. | |
| 11,330,863 | B2 * | 5/2022 | Reddy | A43B 13/42 |
| 2004/0093766 | A1 * | 5/2004 | Hahn | A43B 3/34 36/3 R |
| 2005/0150132 | A1 | 7/2005 | Iannacone | |
| 2013/0081305 | A1 | 4/2013 | Byrne | |
| 2013/0239435 | A1 * | 9/2013 | McDowell | A43B 7/087 36/11.5 |

FOREIGN PATENT DOCUMENTS

| | | | | |
|---|---|---|---|---|
| KR | 200207100 | Y1 * | 12/2015 | |
| WO | WO-2019073607 | A1 * | 4/2019 | A43B 13/02 |

* cited by examiner

FOOTBED FOR FOOTWEAR

This application is a continuation-in-part of U.S. patent application Ser. No. 16/407,972, filed May 9, 2019 which claims the benefit of U.S. provisional application No. 62/671,085, filed May 14, 2018, the contents of such applications being herein incorporated by reference.

FIELD OF THE INVENTION

The present invention relates to footwear such as shoes, boots, and so on, and in particular to a footbed for footwear.

BACKGROUND OF THE INVENTION

Footwear comes in a variety of types and sizes, including sandals, shoes and boots. Footwear includes soles and insoles that protect and cushion the bottoms of the feet. A footbed is a type of insole that is inserted within a space between the shoe sole and shoe upper such that is rests upon an upper surface of the shoe sole or midsole.

When walking, the heel of the foot strikes the ground first, followed by the forefoot. As the foot pushes off, the foot bends so that the heel rises and the forefoot is the last part to remain in contact with the ground. The heel takes the brunt of the force of the foot contacting the ground. Yet, the forefoot also experiences forces when the foot is landing on the ground and pushing off therefrom.

Much walking is done on hard surfaces, such as concrete, tile, etc. For example, walking on sidewalks and across streets involves concrete or asphalt surfaces. A shoe sole and footbed protect the foot from the impact with such hard surfaces.

In the prior art, Gaspard EU Patent No. 0383685 discloses a shoe sole with balls in the outsole. The balls are loosely provided in the outsole and are designed to move about. Oatman, U.S. Pat. No. 4,658,515 discloses an insole comprising apertures loosely filled with particles of insulating plastic material. Grim, U.S. Pat. No. 5,392,534 discloses soles with bladders filled with small spherical particles. U.S. Pat. No. 8,347,526, Goldston et al, provides a shoe including a shoe device comprising springs. Iannacone, U.S. Pat. Pub. No. 2005/0150132 provides footwear with small beads stuffed into the footbed which can shift. U.S. Pat. Pub. No. 2013/0081305, Byrne, discloses an article of footwear comprising a resilient midsole and a stretch zone.

It is desired to provide a footbed that provides improved protection and comfort.

SUMMARY OF THE INVENTION

A footbed for an article of footwear comprises an upper surface and a cushion comprising a lower surface. The footbed further comprises heel and forefoot portions comprising resilient balls located in a resilient matrix material. The balls have a first hardness measure, and the matrix material has a second hardness measure that is different than the first hardness measure.

In accordance with one aspect, the first hardness measure of the balls is greater than the second hardness measure of the matrix material.

The cushion lower surface is configured to engage with an upper surface of a shoe sole, midsole, shoe liner, and the like.

In accordance with another aspect, the cushion comprises a heel portion and a forefoot portion, the forefoot portion comprising balls in a forefoot matrix material, the heel portion comprising balls in a heel matrix material.

In accordance with another aspect, the balls in the forefoot portion are of a first diameter and the balls in the heel portion are of a second diameter, the first diameter being smaller than the second diameter.

In accordance with another aspect, the heel portion is separated from the forefoot portion by a midfoot portion.

In accordance with another aspect, the balls in the cushion form a single layer of balls.

In accordance with another aspect, each of the balls in the cushion is interconnected with adjacent respective balls by spacing pins. The spacing pins creating gaps between adjacent respective balls, the matrix material being located in the gaps.

In accordance with another aspect, the matrix material substantially surrounds each of the balls in the cushion.

In accordance with another aspect, there is an upper cover over the cushion.

In accordance with another aspect, the first hardness measure of the balls is greater than the second hardness measure of the matrix material.

DESCRIPTION OF THE PREFERRED EMBODIMENT

The present invention provides a cushioned footbed for footwear that is both comfortable and provides support to the foot. The footbed has heel and forefoot portions comprising resilient balls. The balls can be loose or encompassed within a resilient matrix material. The balls provide cushioning for the foot. The balls are typically, at least partially, hidden from view. A visual indication can be provided that the footbed contains cushioning balls.

The footwear includes shoes, boots and so on. Examples of footwear include casual shoes, recreational shoes, athletic shoes, outdoor shoes and dress shoes. Further examples of footwear include cowboy boots, western boots, riding boots, outdoor boots, hiking boots and work boots. Additional examples of footwear include specialty footwear such as military boots.

Figure 8:
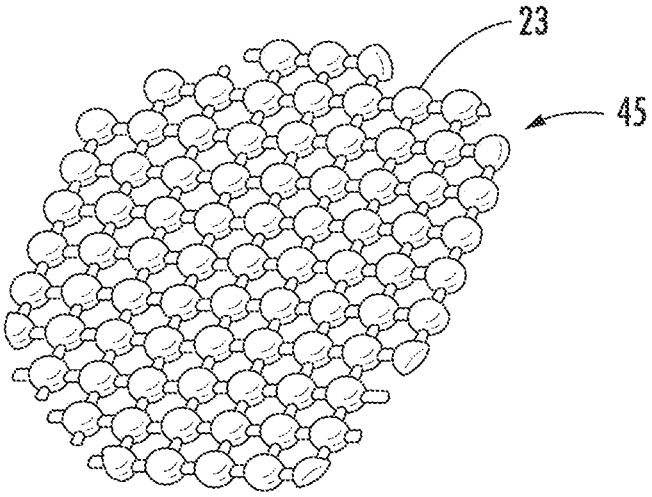
FIG. 8 is a plan view of the forefoot ball assembly of the footbed of FIG. 1.
Figure 9:
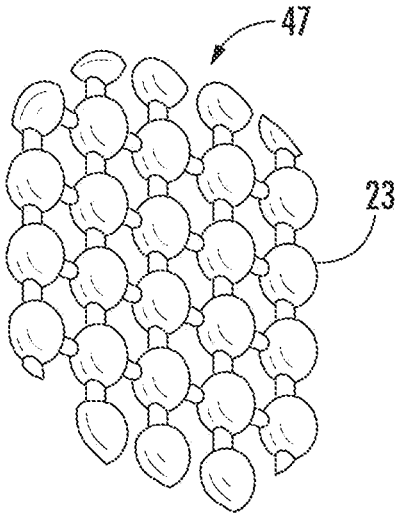
FIG. 9 is a plan view of the heel ball assembly of the footbed of FIG. 1.

Referring to FIGS. 1-7, the footbed 11 is adapted to be inserted within a piece of footwear 15. The footbed 11 comprises a footbed cover 7 comprising an upper surface 13; and a cushion 9 comprising a lower surface 17. The footbed 11 further comprises heel 19, midfoot 29, and forefoot portions 21. In the preferred embodiment, both the heel portion 19 and forefoot portion 21 comprise resilient balls 23 located in a resilient matrix material 25. As will be discussed in more detail below, in preferred embodiments, the resilient balls 23 are part of a ball assembly 45, 47 (FIGS. 8 & 9). The lower surface 17 is adapted to be positioned adjacent to a shoe sole upper surface 27 or midsole, shoe liner, and the like.

The heel portion 19 and midfoot portion 29 each comprise a perimeter wall 32. The perimeter wall 32 extends upward from the footbed 11 upper surface 13. With such configuration, a user's heel and side portions of the foot near the user's heel are supported laterally as they are "cupped" within the space defined by the perimeter wall 32.

As used herein, the terms "upper", "lower", "top" and "bottom" and similar terms as used to describe spatial relationships between components of the footbed, the footwear and/or between a component of the footbed and footwear and the ground. Such terms are relative to the footwear positioned in an upright orientation on a ground surface. "Ground" includes interior floors and exterior surfaces such as streets, sidewalks, soil, etc.

The footbed 11 further comprises an arch support 31. The arch support 31 is an upwardly extending rounded portion of the midfoot portion 29. The arch support 31 is adapted to generally provide support for an arch portion of a wearer's foot.

Figure 1:
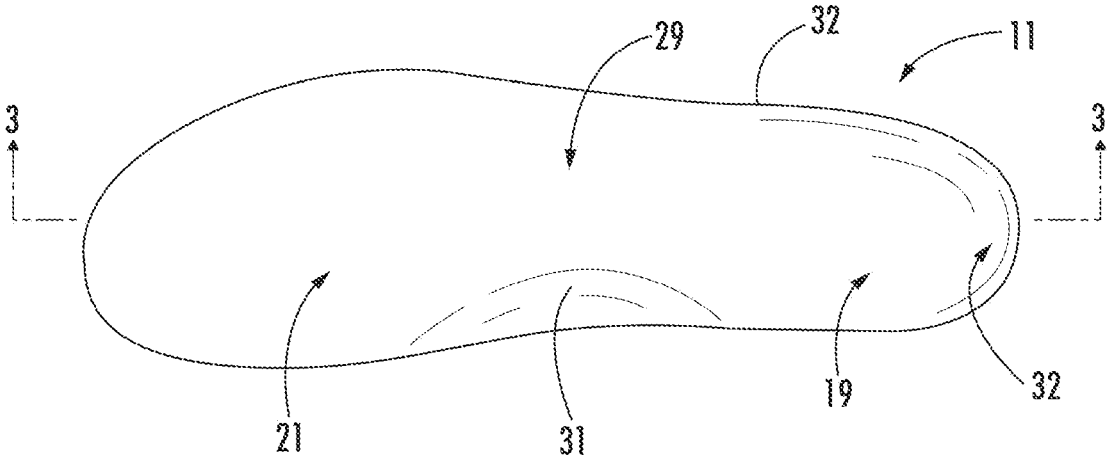
FIG. 1 is a top plan view of a footbed of the present invention, in accordance with a preferred embodiment.
Figure 2:
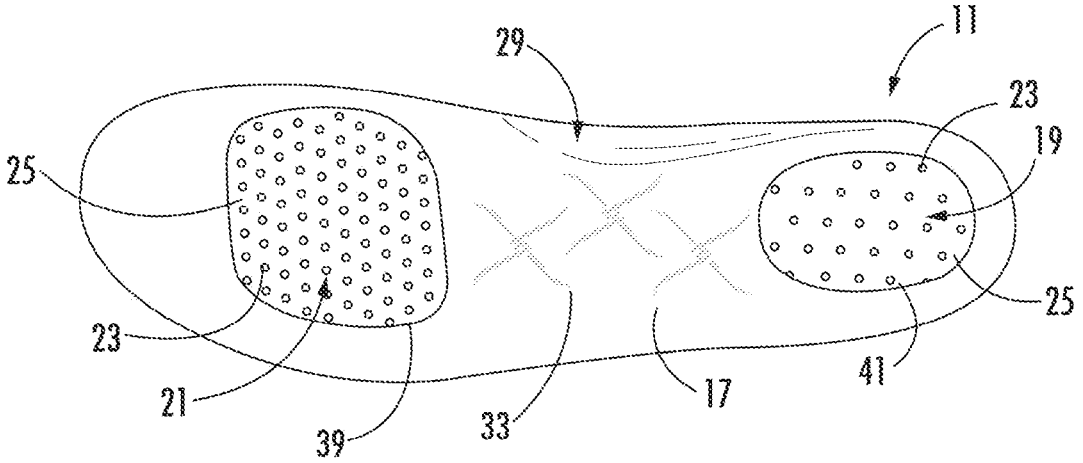
FIG. 2 is a bottom plan view of the footbed of FIG. 1.

The cushion 9 lower surface 17 is typically provided with a surface pattern 33, an example of which is shown in FIG. 2. The surface pattern 33 may include a distinct structure, such as including a non-smooth surface, and in some embodiments including projections and channels and the like. The surface pattern 33 is adapted to maintain the position of the footbed 11 within the footwear 15. However, as the material from which the cushion 9 of the preferred embodiment is formed is generally non-skid in nature, the cushion 9 lower surface 17 need not comprise a surface pattern 33. Rather, the lower surface 17 may also be smooth in some or all areas.

The footbed cover 7 of the preferred embodiment comprises fabric glued to the cushion 9. The fabric of the footbed cover 7 or the preferred embodiment is tightly woven such that the upper surface 13 is typically smooth, although need not be so. The fabric of the footbed cover 7 of the preferred embodiment is anti-bacterial. The anti-bacterial nature of the footbed cover 7 helps maintain a sanitary condition of the footbed 11 even, for example, when the footbed 11 user perspires or when the footbed 11 is otherwise exposed to unsanitary conditions. In preferred embodiments, the footbed 11 is machine washable.

In some embodiments, the upper surface 13 can comprise projections and channels and the like. Although the footbed 11 of the preferred embodiment comprises a footbed cover 7, the footbed 11 need not comprise a footbed cover 7. Rather, the cushion 9 can be exposed at the top such that the upper surface 13 comprises, for example, resilient matrix material 25 rather than fabric.

Referring to FIGS. 2-6, the forefoot 21 and heel portions 19 contain balls 23 or spheres. The balls 23 are solid and are made of a resilient material such as Polyurethane-Elastomer (PU-E), thermoplastic rubber (TPR), polyurethane (PU), polyethylene or ethylene-vinyl acetate rubber (EVA). In the preferred embodiment, the balls 23 are made from PU-E and have a durometer hardness measure of Asker® C 42 degrees. The balls 23 in the forefoot portion 21 are smaller than the balls in the heel portion 19. In some embodiments, actual size of the balls 23 depends on footbed 11 size which is a function of shoe size (with larger footbed 11 sizes having larger balls 23 than smaller footbed 11 sizes). For example, the balls 23 in the forefoot portion 21 can be 4-12 mm in diameter, while the balls 23 in the heel portion 19 can be 8-18 mm in diameter. In the embodiments shown in FIGS. 2, 3, 8 & 9, the balls 23 in the forefoot portion 21 are approximately 7 mm in diameter and the balls 23 in the heel portion 19 are approximately 15 mm.

Figure 3:
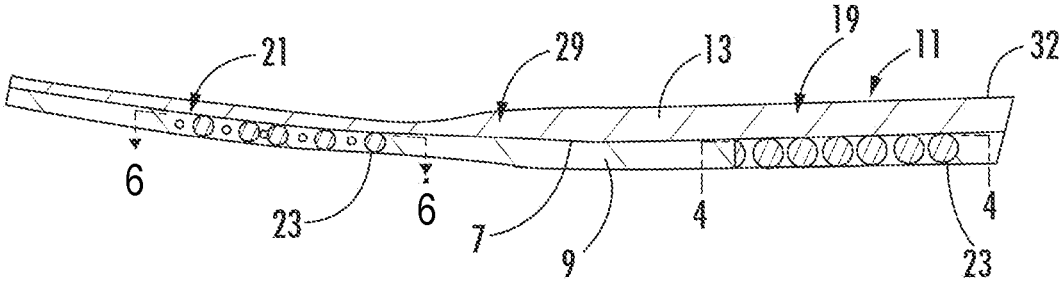
FIG. 3 is a cross-sectional view of the footbed, taken through lines 3-3 of FIG. 1.
Figure 4:
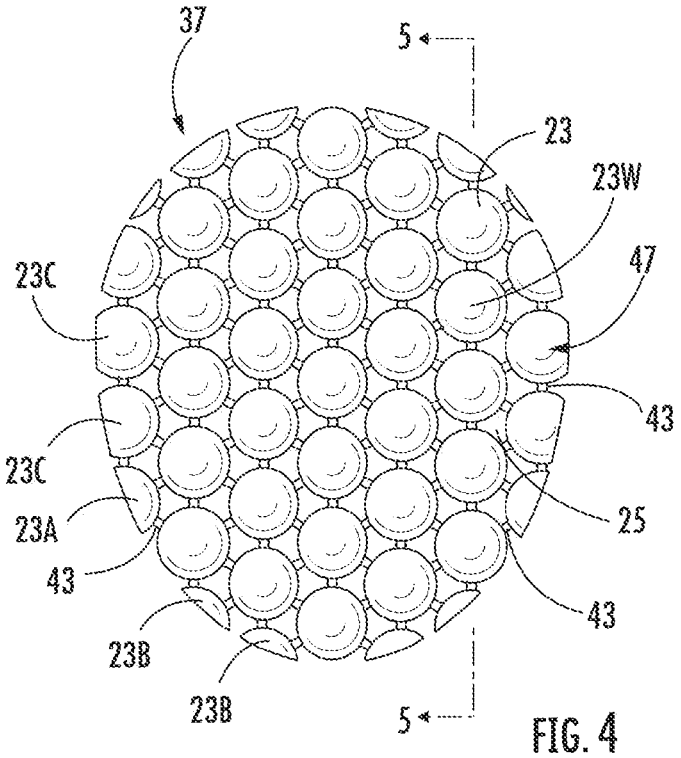
FIG. 4 is a cross-sectional view of the footbed, taken through lines 4-4 of FIG. 3.
Figure 5:
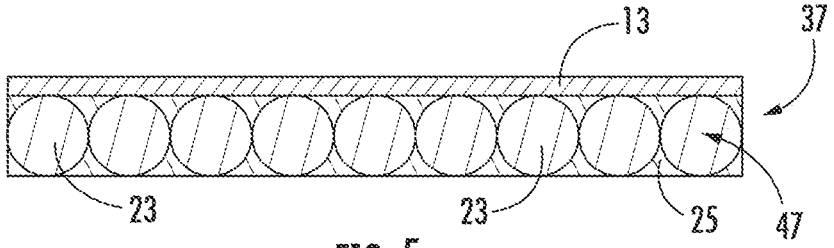
FIG. 5 is a cross-sectional view of the footbed, taken through lines 5-5 of FIG. 4.
Figure 6:
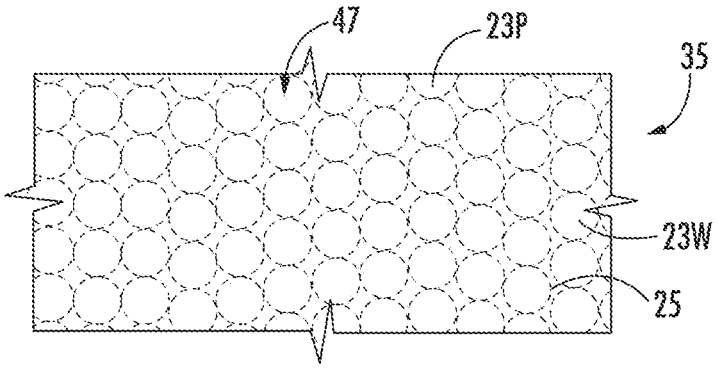
FIG. 6 is a cross-sectional view of the footbed, taken through lines 6-6 of FIG. 3.
Figure 7:
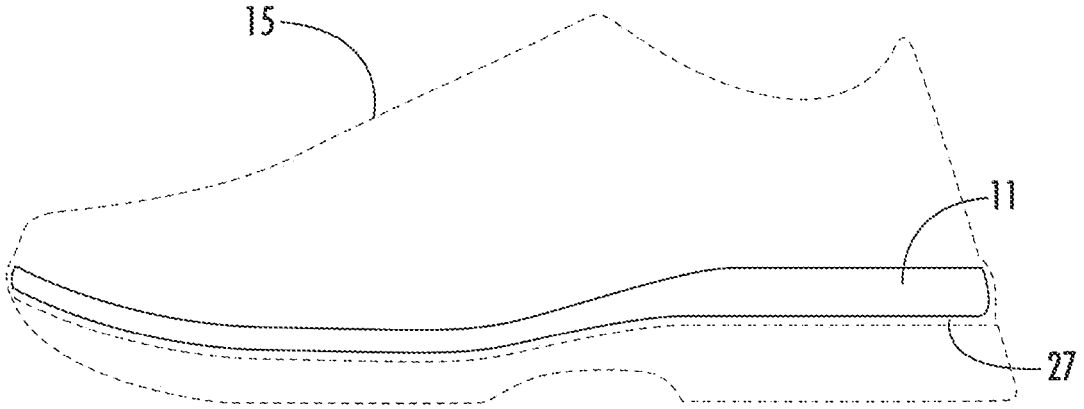
FIG. 7 is a conceptual depiction of the footbed positioned within a piece of footwear.

The forefoot portion 21 has a single layer of balls 23. The heel portion 19 also has a single layer of balls 23. However, in other embodiments, the forefoot and heel portions 21, 19 may comprise single or double layers. The balls 23 of the preferred embodiment are in contact with one another, although the balls 23 are not deformed by the contact. In the heel portion 19, the balls can be arranged as shown in FIGS. 3, 4 and 5.

The midfoot portion 29 of the preferred embodiment does not comprise balls 23.

In certain embodiments, and as best seen in FIG. 2, the balls 23 are near enough to the cushion lower surface 17 that they are partially visible to the user. Thus, a customer, when shopping for footbeds, can view the balls 23 and visually affirm that the footbed 11 contains balls 23. However, the balls 23 need not be visible to the user. Rather, the balls 23 can be entirely surrounded by resilient matrix material 25 such that they are not visible to the user.

The footbed 11 cushion 7 and resilient matrix material 25 are preferably made of polyurethane (PU). However, the footbed cushion 7 and resilient matrix material 25 can be formed from ethylene-vinyl acetate rubber (EVA) or thermoplastic urethane (TPE).

In use, when foot pressure is not applied to the footbed 11, the balls 23 are generally spherical in shape. As foot pressure is applied the footbed 11, the balls 23 compress down. Foot pressure is unevenly distributed across the top of the footbed 11. The heel portion 19 experiences higher pressure than the forefoot portion 21 and midfoot portion 29. The forefoot portion 21 experiences higher pressure than the midfoot portion 29. However, the foot pressure applied to the forefoot portion 21 is typically uneven, with the balls of the feet producing a higher pressure on the footbed 11 than the other forefoot portion 21 areas. The balls 23 under the highest foot pressure compress more. As the foot pressure is released, such as during walking when the foot is raised to take the next step, the balls 23 resume their spherical shape. The wearer thus experiences softened steps. If walking over a hard ground surface such as concrete, the wearer's feet are protected from the hardness of the ground.

Referring to FIGS. 2-8 the footbed 11 is provided with a cushion 9 that include a forefoot ball matrix 35 and a heel ball matrix 37. The forefoot and heel matrices 35, 37 are shaped in a non-geometrical manner. That is to say, the matrices 35, 37, when viewed in plan view from the top, are not circular or oval in shape. The matrices 35, 37 are shaped to the foot. The forefoot ball matrix 35 of the preferred embodiment generally comprises an outside configuration shown in FIG. 8 (depicted such that the bottom of the figure would be oriented closer to the heel portion 19). The heel ball matrix 37 of the preferred embodiment generally comprises an outside configuration shown in FIG. 9 (depicted such that the top of the figure would be oriented closer to the forefoot portion 21). The ball matrices 35, 37 capture the balls 23 and prevent the movement of the balls 23 with respect to each other. The ball matrices 35, 37 provide the flexibility of the balls 23 and the surrounding matrix material 25.

Each ball matrix 35, 37 has the balls 23 encased in a flexible resilient matrix material 25. The matrix material 25 fills the spaces between the balls 23, thereby preventing the balls 23 from moving with respect to one another. In preferred embodiments, the tops and bottoms of the balls 23 are visible at the respective top and bottom surfaces of the matrix 35, 37. This allows the resiliency of the balls 23 to be utilized when foot pressure is applied. Covering the tops and bottoms of the balls 23 with matrix material 25 would dampen the resiliency of the balls, as the matrix material 25 would absorb more of the foot pressure. The matrix material 25 is made of a flexible and resilient material such as polyurethane. The durometer hardness measure of the matrix material 25 of the preferred embodiment is Asker® C 30 degrees. There is a differential in durometers hardness measures between the balls 23 and the matrix material 25, with the balls 23 being harder. For example, if the matrix material 25 has a durometer hardness measure of Asker® C 30 degrees, the durometer hardness measure of the balls is Asker® C 42 degrees. The durometer hardness measure of the matrix material 25 may be greater or lesser than Asker® C 30 degrees.

To make the footbed 11 the ball matrices assemblies 45, 47 are placed into a footbed mold comprising areas that define the outline of the respective matrices 35, 37. For the forefoot ball matrix 35, the balls 23 are typically arranged in a single layer. For the heel ball matrix 37, the balls 23 are typically arranged in a single layer, but, in some embodiments, can be placed in a double layer. The footbed mold is then filled with the matrix material 25. In preferred embodiments, the matrix material 25 covers substantially all of the surface area of the balls 23. In some embodiments, as shown, for example, in FIGS. 2 and 3, the top portions and bottom portions of the balls 23 are not covered by the matrix material 25. Likewise, the balls 23 adjacent to the edges 39, 41 of the respective ball matrices 35, 37 in some embodiments have exposed surfaces that are not covered by the matrix material 25. As seen in FIG. 2, these edges 39, 41 comprise grooves in the cushion 9 which define the outline of the respective matrices 35, 37. Once the matrix material 25 has cured, the footbed 11 is removed from the mold.

The provision of the matrix material 25 maintains the relative positions of the balls 23 with respect to one another, while still allowing the balls 23 to compress under foot pressure and resume a spherical shape when foot pressure is removed. In this manner, the balls 23 do not shift or move. In addition, the matrix material 25 provides cushioning and resiliency in addition to the balls 23, adding to the overall cushioning of footbed 11. As foot pressure is applied to the footbed 11, the ball matrices 35, 37 compress. Thus, the balls 23 and the matrix material 25 compress under the foot pressure. When foot pressure is removed, the balls 23 and matrix material 25 decompress.

As indicated above, the balls 23 in the preferred embodiment are parts of ball assemblies 45, 47 as depicted in FIGS. 8 & 9. In such assemblies 45, 47, adjacent balls 23 and are slightly spaced apart from one another. In the preferred embodiment, each ball 23 is connected to the adjacent balls 23 by pins 43 (or rods). For example, referring to FIG. 4, a ball 23 surrounded by six other balls is connected to each adjacent ball by a pin 43, for a total of six pins 43. In other embodiments, as shown in FIGS. 8 & 9, each ball 23 surrounded by adjacent balls is connected to such adjacent balls 23 by four pins 43, such that, for example, a particular ball 23 surrounded by six adjacent balls 23 is connected by pins 43 to four of the six balls 23.

The pins 43 are solid and serve several purposes. One purpose is during manufacturing. The ball assembly 45, 47 is injection molded and the pins 43 serve as sprues to connect ball cavities together in the mold. Another purpose is for assembly; the ball assembly can be placed inside a mold with the balls 23 correctly positioned and intact. This assures that each footbed 11 has the correct number and placement of balls 23. In the case of the heel portion 19, if two layers of balls 23 are used, then two ball assemblies 37, 37 are used, namely an upper ball assembly 37 and a lower ball assembly 37. The spacing is small relative to the size of the balls 23. For example, with balls of 4-12 mm diameter, the spacing between balls is 1-2 mm. For balls of 8-18 mm, the spacing between balls is 2-3 mm.

As best shown in FIGS. 4, the ball assemblies 45, 47 include whole balls 23W and partial balls 23P. Whole balls 23W are of course complete spheres. Partial balls 23A-23C are less than whole spheres. The partial balls 23A-23C are located around the periphery of the ball assembly 45, 47. For example, as shown in FIG. 4 one or more balls 23A are an approximate hemisphere. A hemisphere may be connected to three adjacent balls 23. Other balls 23B are less than a hemisphere; such balls 23B are connected to two adjacent balls 23. Still other balls 23C are more than a hemisphere, but less than a complete sphere; such balls 23C are connected to four adjacent balls.

The provision of partial balls 23A, 23B, 23C along the periphery of the ball assemblies 39, 41 allows for a staggered fit of the balls 23 with respect to one another and also allows for filling spaces along the periphery of the ball assembly when inserted into the mold. The balls 23 are staggered in fit as shown in FIG. 4. The balls 23 in one row may be staggered or offset with respect to the balls 23 in an adjacent row (FIG. 5 is a cross-section taken through a row of balls 23). Thus, the balls 23 in one row may be aligned with the spaces between the balls 23 in an adjacent row. Such a staggered arrangement allows a ball 23 to be connected to six adjacent balls 23 by way of pins 43 as shown in FIG. 4 or four adjacent balls 23 by way of pins 43 as shown in FIGS. 8 and 9. A non-staggered arrangement, such as an aligned arrangement, has the balls 23 in a ball assembly 45, 47 aligned in rows and columns, where each ball 23 would be connected to four adjacent balls 23 by way of pins 43. A staggered arrangement allows for a closer fit of the balls 23 than does an aligned arrangement. By providing partial balls 23A, 23B, 23C, the balls 23 in the ball assembly 45, 47 can fit within predetermined positions. The partial balls 23A, 23B, 23C serve to fill much of the peripheral space between the whole balls 23W and, for example, the edges 39, 41.

FIGS. 4 & 5 show the ball assembly 47 in a ball matrix 37. The spaces between the balls 23 are filled with the matrix material 25. Thus, the matrix material 25 adds to the overall resiliency of the ball matrix 37.

In other embodiments, the ball matrix 35, 37 is made in a mold. The ball assembly 45, 47 or assemblies 45, 47 are located in the mold and the mold filled with the matrix material 25. The resulting ball matrix 35, 37 has the same shape as the mold. Once the matrix material 25 cures, the ball matrix 35, 37 can be inserted into the cushion 9.

The pins 43 may disconnect or break away from the balls 23 when the footbed 11 is in use. If the ball assembly 45, 47 is in a matrix 35, 37, the balls 23 remain fixed in place by the matrix material 25. If the balls 23 are not in a matrix 35, 37, then the balls 23 can move slightly relative to the other balls 23. However, the relative positions of the balls 23 remain unchanged. For example, the balls 23 in one row can move about between the adjacent rows.

The foregoing disclosure and showings made in the drawings are merely illustrative of the principles of this invention and are not to be interpreted in a limiting sense.

We claim:

1. A footbed adapted to be inserted into footwear, the footbed comprising:

a cushion comprising a heel portion, a forefoot portion, and a lower surface;

the heel and forefoot portions each comprising resilient balls located in a resilient matrix material;

the matrix material substantially encapsulating each of the balls in the cushion except at a top portion and a bottom portion of the balls;

the balls being in a fixed position relative to the matrix material such that the balls do not freely move within the respective heel and forefoot portions;

the balls having a first hardness measure and the matrix material having a second hardness measure, the balls' first hardness measure being greater than the matrix material's second hardness measure.

2. The footbed of claim 1, wherein the balls in the forefoot portion are of a first diameter and the balls in the heel portion are of a second diameter, the first diameter being smaller than the second diameter.

3. The footbed of claim 2, wherein the heel portion is separated from the forefoot portion by a midfoot portion.

4. The footbed of claim 1 wherein the balls in the cushion form a single layer of balls.

5. The footbed of claim 4, wherein:

each of the balls in the cushion is interconnected with adjacent respective balls by spacing pins, the spacing pins creating gaps between adjacent respective balls, the matrix material being located in the gaps.

6. The footbed of claim 1, wherein each of the balls in the cushion is interconnected with adjacent respective balls by spacing pins, the spacing pins creating gaps between adjacent respective balls, the matrix material being located in the gaps.

7. The footbed of claim 6, wherein at least one of the balls is connected to six adjacent balls by six respective spacing pins.

8. The footbed of claim 6, wherein at least one of the balls is connected to four adjacent balls by four respective spacing pins.

9. The footbed of claim 6, wherein at least one ball is surrounded by six adjacent balls.

10. The footbed of claim 6, the interconnected balls being a ball assembly, wherein at least one of the balls is a partial ball that is less than a whole sphere and is located at a periphery of the ball assembly.

11. The footbed of claim 1, further comprising an upper cover over the cushion.

12. The footbed of claim 1, wherein:

each of the balls in the cushion is interconnected with adjacent respective balls by spacing pins, the spacing pins creating gaps between adjacent respective balls, the matrix material being located in the gaps; and wherein the interconnected balls being a ball assembly, wherein at least one of the balls is a partial ball that is less than a whole sphere and is located at a periphery of the ball assembly.

13. A footbed adapted to be inserted into footwear, the footbed comprising:

a cushion comprising a heel portion, a forefoot portion, and a lower surface;

the heel portion being separated from the forefoot portion by a midfoot portion;

the heel and forefoot portions each comprising resilient balls located in a resilient matrix material;

the matrix material substantially encapsulating each of the balls in the cushion except at a top portion and a bottom portion of the balls;

the balls being in a fixed position relative to the matrix material such that the balls do not freely move within the respective heel and forefoot portions;

the balls having a first hardness measure and the matrix material having a second hardness measure, the balls' first hardness measure being greater than the matrix material's second hardness measure;

the balls in the forefoot portion having a first diameter and the balls in the heel portion having a second diameter, the first diameter being smaller than the second diameter;

the balls in the cushion forming a single layer of balls;

the balls being interconnected with adjacent respective balls by spacing pins, the spacing pins creating gaps between adjacent respective balls, the matrix material being located in the gaps;

the interconnected balls being a ball assembly, wherein at least one of the balls is a partial ball that is less than a whole sphere and is located at a periphery of the ball assembly, an upper cover over the cushion.

14. The footbed of claim 13, wherein at least one of the balls is connected to six adjacent balls by six respective spacing pins.

15. The footbed of claim 13, wherein at least one of the balls is surrounded by six adjacent balls and is connected to four adjacent balls by four respective spacing pins.

* * * * *